US005171486A

United States Patent [19]

Penno

[11] Patent Number: 5,171,486

[45] Date of Patent: Dec. 15, 1992

[54] ROTATING HUMIDIFIER

[76] Inventor: Harry Penno, 60 Lissington Drive SW., Calgary, Alberta, Canada, T3E 5E3

[21] Appl. No.: 806,005

[22] Filed: Dec. 9, 1991

[51] Int. Cl.[5] ..... B01F 3/04; B01F 5/00

[52] U.S. Cl. ..... 261/92; 261/DIG. 15

[58] Field of Search ..... 261/92, DIG. 15

[56] References Cited

U.S. PATENT DOCUMENTS

| | | | |
|---|---|---|---|
| 372,178 | 10/1887 | Simpkin | 261/92 |
| 406,124 | 7/1889 | Chandler et al. | 261/92 |
| 462,102 | 10/1891 | Schmid | 261/92 |
| 1,311,224 | 7/1919 | Ginther | 261/92 |
| 1,846,057 | 2/1932 | Ilg | 261/92 |
| 1,848,559 | 3/1932 | Cheyney | 261/92 |
| 1,942,502 | 1/1934 | Werhan et al. | 261/92 |
| 2,076,660 | 4/1937 | Matteson et al. | 261/92 |
| 2,324,386 | 7/1943 | Gusy | 261/92 |
| 3,956,127 | 5/1976 | Holmberg | 261/92 |
| 4,160,736 | 7/1979 | Prosser | 261/92 |

FOREIGN PATENT DOCUMENTS

| | | | |
|---|---|---|---|
| 885029 | 11/1971 | Canada | 261/92 |

*Primary Examiner*—Tim Miles

*Attorney, Agent, or Firm*—Jerry T. Kearns

[57] ABSTRACT

A humidifier includes a rotating circular base plate driven by a motor through a gear reduction mechanism. A plurality of elongated troughs are mounted in a spaced circular array adjacent a periphery of the base plate, such that outer edges of the troughs are disposed on the surface of a cylinder. The troughs may have a variety of different transverse cross-sectional shapes, such as semi-circular, U-shaped, or V-shaped. A centrally disposed drive shaft extends axially from the base plate and includes a plurality of radially extending circumferentially spaced fins. The rotating base plate and attached troughs are mounted in a housing having an inlet duct and an outlet duct connected in a cold air return duct of a conventional forced air type furnace. A water tank disposed in the bottom of the housing is connected by a float valve to a water supply source such that a constant water level is maintained in the tank. As the base plate rotates, the troughs scoop up water, carry it upwardly into the air flow path, and gradually spill the water to create a waterfall in the air flow path. The radial fins on the drive shaft create turbulence in the air flow path to maximize the amount of moisture entrained in the air flow stream.

14 Claims, 2 Drawing Sheets

ROTATING HUMIDIFIER

BACKGROUND OF THE INVENTION

1. Field of the Invention

The present invention relates to humidifiers, and more particularly pertains to a humidifier which avoids the use of conventional filters and pads. Conventional forms of humidifiers employ pads or filters which are dipped into a water reservoir by a rotating drum, or alternatively employ spray nozzles to saturate the filters or pads. These filters or pads tend to become dirty, creating an environment for the propagation of disease causing organisms. To prevent potential respiratory illnesses from resulting, the pads and filters must be frequently changed and/or cleaned. One conventional type of humidifier employs a pad disposed over a rotating drum which picks up water from a reservoir as the drum rotates. Inlet air to a forced air furnace then passes through the pad, raising the humidity level. As scaling due to hard water and minerals deposits forming on the pad occurs, the air is less able to pass through the pad, which decreases the efficiency of the humidifier and eventually results in the pad becoming totally clogged, with no air passing through the humidifier pad whatsoever. The pad must either then be cleaned or replaced. Hard water scaling will also clog up the valve and float mechanism utilized to maintain a constant water level in the reservoir. If left unattended, the malfunctioning float valve will result in the water level in the reservoir decreasing, eventually causing complete failure of the humidifier. Additionally, in most humidifiers employing a reservoir or tray, there are certain areas of the tray where water does not circulate. This results in the formation of a scum, necessitating frequent cleaning.

2. Description of the Prior Art

Various types of humidifiers are known in the prior art. A typical example of such a humidifier is to be found in U.S. Pat. No. 1,846,057, which issued to R. Ilg on Feb. 23, 1932. This patent discloses a humidifier which employs a spoked wheel including a plurality of scoops for moving water from a reservoir onto screens for entrainment in an air flow. U.S. Pat. No. 1,942,502, which issued to W. Werhan et al. on Jan. 9, 1934, discloses a humidifier including a water tank regulated by a float valve and a pair of rotating spoked wheels for distributing water from the tank onto baffle plates by centrifugal force. U.S. Pat. No. 2,324,386 which issued to E. Gusy on Jul. 13, 1943, discloses a humidifier employing rotatable fans having blades immersed in a water reservoir for entraining water in an air stream. U.S. Pat. No. 3,956,127, which issued to L. Holmberg on May 11, 1976, discloses a mixing drum for establishing contact between a liquid and a gas which includes a plurality of perforated pipes disposed in a circular array and mounted for rotation. U.S. Pat. No. 4,160,736, which issued to D. Prosser on Jul. 10, 1979, discloses a rotating filter employing a circular array of angular channel members to collect water from a shallow pool at the bottom of a cylindrical shell. Canadian Patent No. 885,029 discloses a humidifier which employs a rotating drum having a mesh surface which is saturated by immersion in a float valve regulated water tank. The drum includes internal turbine vanes which effect rotation of the drum by power derived from the air stream of a forced air heating system.

SUMMARY OF THE INVENTION

Representative embodiments of the concepts of the present invention are illustrated in the drawings and make use of a rotating circular base plate driven by a motor through a gear reduction mechanism. A plurality of elongated troughs are mounted in a spaced circular array adjacent a periphery of the base plate, such that outer edges of the troughs are disposed on the surface of a cylinder. The troughs may have a variety of different transverse cross-sectional shapes, such as semi-circular, U-shaped, or V-shaped. A centrally disposed drive shaft extends axially from the base plate and includes a plurality of radially extending circumferentially spaced fins. The rotating base plate and attached troughs are mounted in a housing having an inlet duct and an outlet duct connected in a cold air return duct of a conventional forced air type furnace. A water tank disposed in the bottom of the housing is connected by a float valve to a water supply source such that a constant water level is maintained in the tank. As the base plate rotates, the troughs scoop of water, carry it upwardly into the air flow path, and gradually spill the water to create a waterfall in the air flow path. The radial fins on the drive shaft create turbulence in the air flow path to maximize the amount of moisture entrained in the air flow stream.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the public generally, and especially those who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved humidifier which has all the advantages of the prior art humidifiers and none of the disadvantages.

It is another object of the present invention to provide a new and improved humidifier which may be easily and efficiently manufactured and marketed.

It is a further object of the present invention to provide a new and improved humidifier which is of a durable and reliable construction.

An even further object of the present invention is to provide a new and improved humidifier which is susceptible of a low cost of manufacture with regard to both materials and labor, and which accordingly is then susceptible of low prices of sale to the consuming public, thereby making such humidifiers economically available to the buying public.

Still yet another object of the present invention is to provide a new and improved humidifier which provides in the apparatuses and methods of the prior art some of the advantages thereof, while simultaneously overcoming some of the disadvantages normally associated therewith.

Still another object of the present invention is to provide a new and improved humidifier which utilizes a circular array of elongated troughs mounted on a plate driven in rotation to entrain water from a tank in an air stream from a forced air furnace.

Yet another object of the present invention is to provide a new and improved humidifier which does not utilize any filters or pads, and thus avoids the tedious periodic replacement and cleaning of filters and pads.

Even still another object of the present invention is to provide a new and improved humidifier which utilizes a rotating circular array of troughs in conjunction with a plurality of triangular fins to create maximum entrainment of water in an air stream.

A further object of the invention is to provide a new and improved humidifier which maintains constant circulation in a reservoir tray to eliminate scum formation and frequent cleaning.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
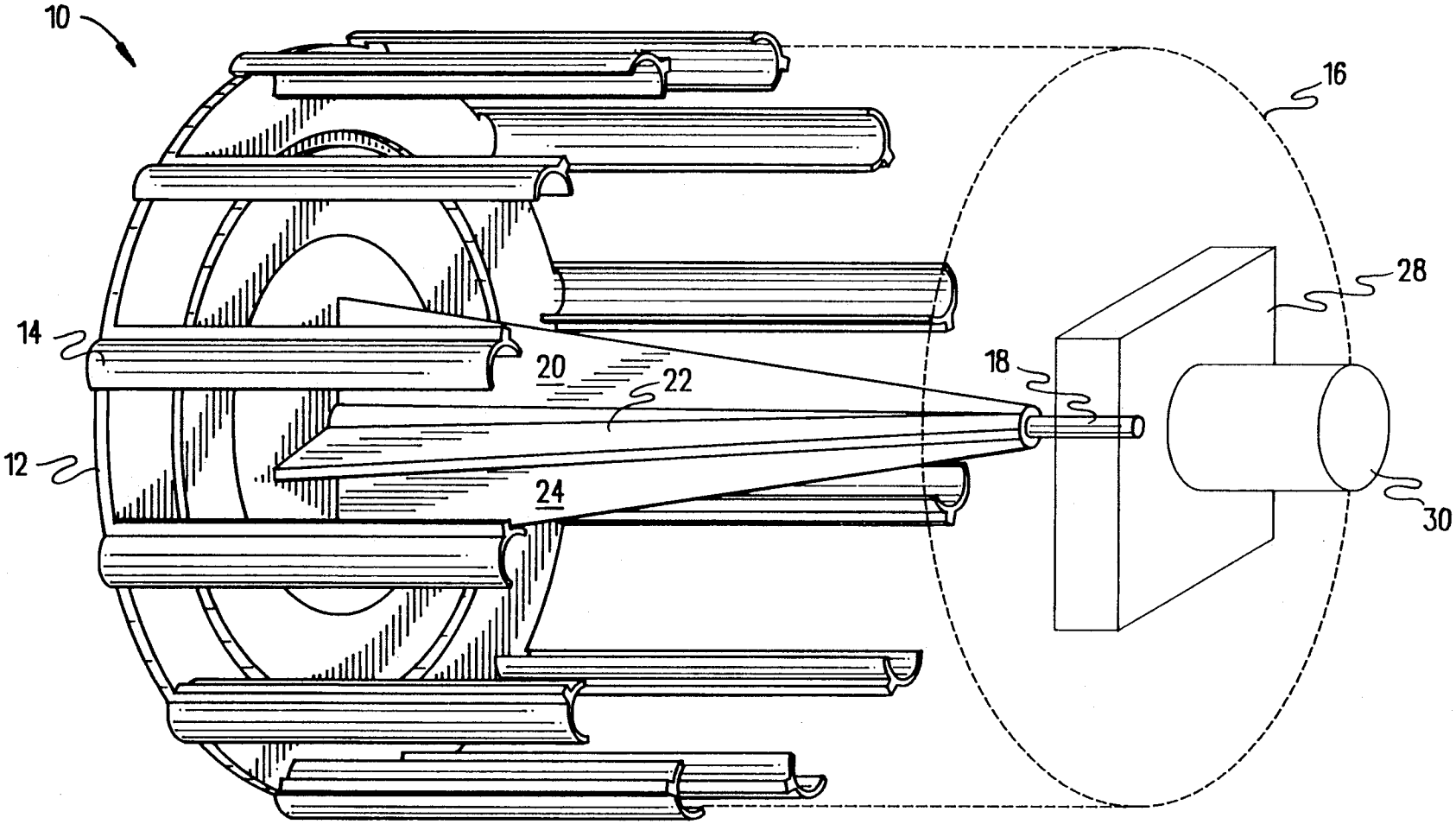
FIG. 1 is a perspective view illustrating the humidifier according to the present invention.

With reference now to the drawings, and in particular to FIG. 1 thereof, a new and improved humidifiers embodying the principles and concepts of the present invention and generally designated by the reference numeral 10 will be described.

Figure 3:
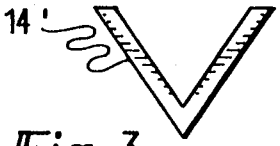
FIG. 3 is an end view illustrating an alternative V-shape water carrying trough for use with the humidifier of the present invention.
Figure 4:
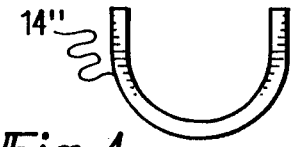
FIG. 4 is an end view illustrating an alternative U-shape water carrying trough for use with the humidifier of the present invention.

More specifically, it will be noted that the first embodiment 10 of the invention includes a circular base plate 12 upon which a.plurality of equally radially and circumferentially spaced troughs 14 are mounted. The troughs 14 are axially elongated and extend substantially perpendicular from a peripheral edge of the plate 12, such that an outer edge of each trough 14 is disposed on the surface of a cylinder 16. The troughs 14 may be formed with a variety of different transverse cross-sectional shapes, such as cylindrical 14 as illustrated in FIGS. 1 and 2, V-shaped 14' as shown in FIG. 3, or U-shaped 14" as shown in FIG. 4.

A drive shaft 18 is rigidly mounted at a central location on the base plate 12 and includes four triangular fins 20, 22, 24, 26 disposed at equal ninety degree angular increments about the shaft 18 and rigidly mounted thereto for rotation therewith. The wider base ends of the fins 20, 22, 24 and 26 are secured to the base plate 12, and serve to strengthen the connection of the drive shaft 18 to the base 12. A terminal end of the shaft 18 is connected to a gear reduction mechanism 28 which couples the shaft 18 to an output shaft of an electric motor 30. The gear reduction mechanism 28 and motor 30 are mounted by suitable plates or brackets and associated fasteners to a fixed housing. The gear reduction mechanism 28 may take a variety of conventional forms, within the scope of the invention. A belt and pulley drive may be employed, as an alternative to gear driven reduction units. The electric motor 30 is connected in a conventional manner to a source of electric current.

Figure 2:
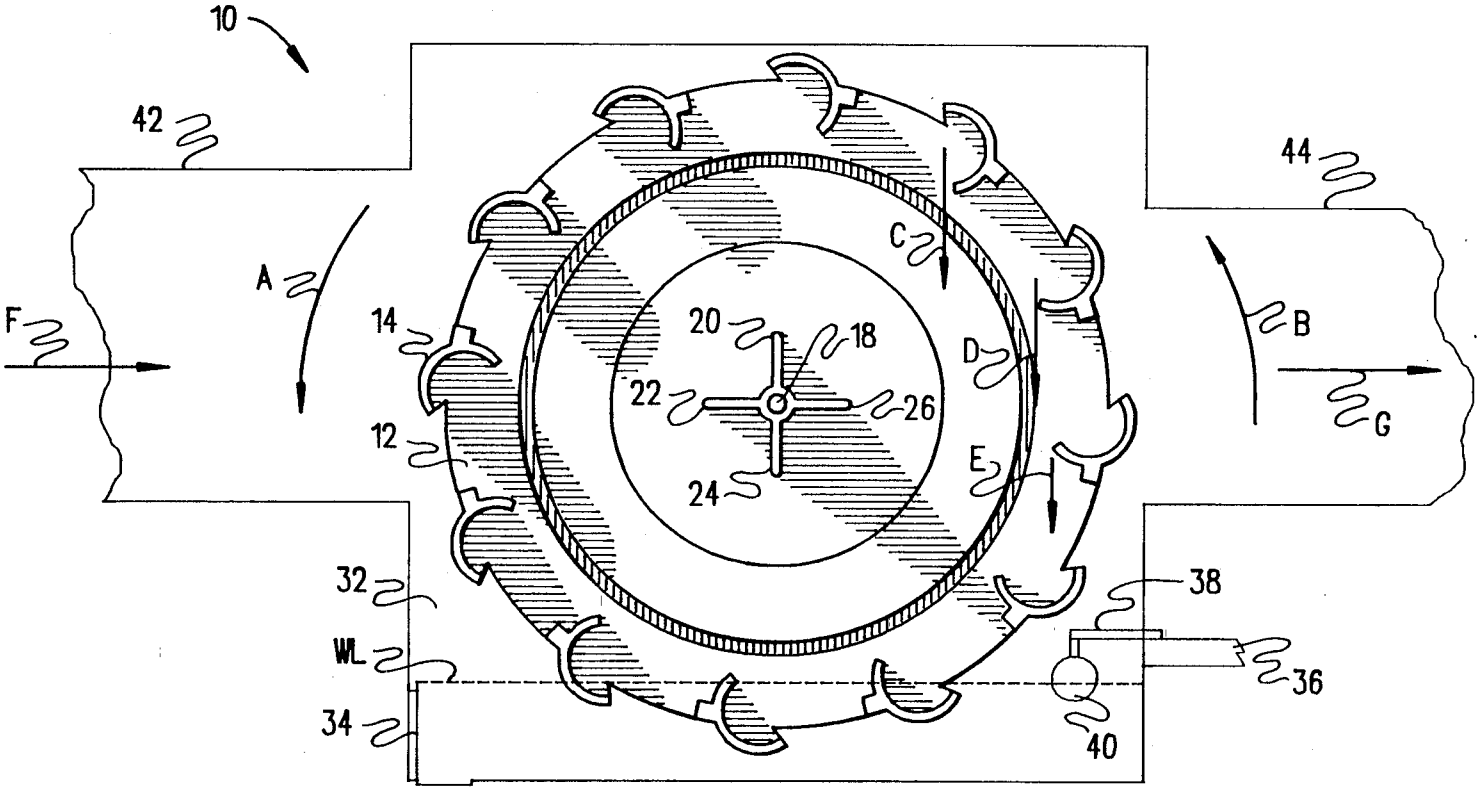
FIG. 2 is an end view illustrating the humidifier according to the present invention.

As shown in FIG. 2, the base plate 12 and attached troughs 14 are mounted within a housing 32, which may be of conventional galvanized sheet metal construction. The housing 32 includes a bottom pan 34 connected to a water supply source 36 by a float valve assembly 38 possessing a float 40, such that a constant predetermined water level WL is maintained within the tank 34. The housing 32 also includes air inlet duct 42 and air outlet duct 44, which are preferably mounted in line with the cold air return duct of a conventional forced air type furnace. While illustrated as having a cubical configuration, the housing 32 may also be cylindrical, within the scope of the invention.

In use, the drive shaft 18, base plate 12 and troughs 14 are constantly driven in rotation in the direction indicated by arrows A and B by electric motor 30 and gear reduction mechanism 28. As the troughs 14 dip into the pan 34, they are filled with water. As the troughs 14 rotate upward out of the pan 34, the water is gradually spilled as the troughs are progressively inverted, such that water falling at positions indicated by arrows C, D, E (and also at intermediate positions) creates a waterfall adjacent the outlet duct 44. The blower associated with the forced air furnace (not shown) causes air to flow through the housing 32 in the direction indicated by arrows F and G. As the air flow F passes through the inlet duct 42 and between the troughs 14, it impinges on fins 20, 22, 24 and 26, resulting in a turbulent air flow pattern. The air flow F entrains water as it passes through the waterfall (generally in the vicinity of arrows C, D and E), an effect which is enhanced by the turbulence created by fins 20, 22, 24 and 26. The humidified air flow G then exits the housing 32 via outlet duct 44. It is contemplated that the drive shaft 18 will be constantly rotated by motor 30, even when the furnace blower is off, thus constantly keeping the water in tank 34 circulating. As a result, the formation of mineral deposits from hard water and the formation of scum within the tank 34 is prevented.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A humidifier for use in a forced air heating system having a cold air return duct, comprising:

a base plate;

an elongated drive shaft extending substantially perpendicular to said base plate and secured centrally to said base plate;

means for rotating said drive shaft and base plate;

a plurality of elongated troughs secured around a periphery of said base plate;

a plurality of elongated fins secured to said drive shaft;

said base plate, said troughs, said drive shaft, and said fins mounted for concurrent rotation in a housing;

said housing including an inlet duct and an outlet duct mounted in a cold air return line of a forced air heating system;

a water tank disposed in a lower portion of said housing;

said base plate and said troughs disposed such that said troughs collect water from said tank at a lowest point of rotation and spill water as they move toward a highest point of rotation, creating a waterfall; and said inlet and outlet ducts and said fins disposed such that turbulence is created in said air entering said housing through said inlet duct prior to passing through said waterfall and said outlet duct.

2. The humidifier of claim 1, wherein said base plate is substantially circular.

3. The humidifier of claim 2, wherein said troughs are disposed in a circular array around a peripheral edge of said base plate.

4. The humidifier of claim 3, wherein said troughs are substantially parallel and disposed in a circular array with substantially equal radial and circumferential spacing.

5. The humidifier of claim 1, wherein said troughs have a semi-cylindrical cross-sectional shape.

6. The humidifier of claim 1, wherein said troughs have a U-shaped cross-sectional shape.

7. The humidifier of claim 1, wherein said troughs have a V-shaped cross-sectional shape.

8. The humidifier of claim 1, wherein said means for rotating said drive shaft and base plate comprises a gear reduction mechanism operably connected to a motor and said drive shaft for driving said base plate in rotation.

9. The humidifier of claim 1, wherein said fins are triangular.

10. The humidifier of claim 9, wherein said fins are disposed at equal angular increments and extend substantially parallel with said drive shaft.

11. A humidifier for use in a forced air heating system having a cold air return duct, comprising:

a substantially circular base plate;

an elongated drive shaft extending substantially perpendicular to said base plate and secured centrally to said base plate;

a gear reduction mechanism operably connected to a motor and said drive shaft for driving said base plate in rotation;

a plurality of elongated troughs secured to a peripheral edge portion of said base plate, said troughs being substantially parallel and disposed in a circular array with substantially equal radial and circumferential spacing;

a plurality of elongated triangular fins secured to said drive shaft at equal angular increments, each of said fins having a widest base portion secured to said base plate;

said base plate, said troughs, said drive shaft, and said fins mounted for concurrent rotation in a housing;

said housing including an inlet duct and an outlet duct mounted in a cold air return line of a forced air heating system;

a water tank disposed in a lower portion of said housing and including a float valve connected to a water source for maintaining a predetermined water level in said tank;

said base plate and said troughs disposed such that said troughs collect water from said tank at a lowest point of rotation and spill water as they move toward a highest point of rotation, creating a waterfall; and said inlet and outlet ducts and said fins disposed such that turbulence is created in said air entering said housing through said inlet duct prior to passing through said waterfall and said outlet duct.

12. The humidifier of claim 11, wherein said troughs have a semi-cylindrical cross-sectional shape.

13. The humidifier of claim 11, wherein said troughs have a U-shaped cross-sectional shape.

14. The humidifier of claim 11, wherein said troughs have a V-shaped cross-sectional shape.

* * * * *